US010890392B1

(12) United States Patent
Pederson

(10) Patent No.: US 10,890,392 B1
(45) Date of Patent: Jan. 12, 2021

(54) GUIDE ROD FOR AUTO RELOADING FIREARM

(71) Applicant: Rolland & Hamann innovations, LLC, Minneapolis, MN (US)

(72) Inventor: Scott James Pederson, Minneapolis, MN (US)

(73) Assignee: Rolland & Hamann Innovations, LLC, Minneapolis, MN (US)

( * ) Notice: Subject to any disclaimer, the term of this patent is extended or adjusted under 35 U.S.C. 154(b) by 0 days.

(21) Appl. No.: 16/787,259

(22) Filed: Feb. 11, 2020

(51) Int. Cl.
*F41A 3/82* (2006.01)
*F41A 9/41* (2006.01)
*F41A 3/86* (2006.01)

(52) U.S. Cl.
CPC ..... *F41A 3/82* (2013.01); *F41A 3/86* (2013.01); *F41A 9/41* (2013.01)

(58) Field of Classification Search
CPC ..... F41A 3/78; F41A 3/80; F41A 3/82; F41A 3/84; F41A 3/86; F41A 3/88; F41A 3/94; F41A 9/41; F41A 25/10; F41A 25/12; F41A 25/14
See application file for complete search history.

(56) References Cited

U.S. PATENT DOCUMENTS 2,581,395 A * 1/1952 Elfstrom ..... F41A 5/20 89/14.3
3,204,531 A * 9/1965 Swieskowski ..... F41A 3/82 89/199
3,399,479 A * 9/1968 Goldstein ..... F41A 9/55 42/9
4,201,113 A * 5/1980 Seecamp ..... F41A 3/86 89/163
4,485,723 A * 12/1984 Sarony ..... F41A 3/86 89/163
8,539,706 B1 * 9/2013 Vieweg ..... F41A 25/10 42/1.06
8,939,059 B2 * 1/2015 Coffman, II ..... F41A 3/80 89/44.01
9,194,650 B2 11/2015 Hangen
9,903,687 B2 2/2018 Mock et al.
2011/0318715 A1 * 12/2011 Markert ..... F41A 33/06 434/18
2015/0377583 A1 * 12/2015 Furusho ..... F41A 3/56 42/1.06
2016/0047613 A1 * 2/2016 Hudson, III ..... F41A 3/86 42/14
2017/0122682 A1 * 5/2017 Mantas ..... F41A 3/86
2018/0010870 A1 * 1/2018 Mantas ..... F41A 3/86
2018/0073825 A1 3/2018 Zukowski
2019/0383572 A1 * 12/2019 Gregorich ..... F41A 3/66

FOREIGN PATENT DOCUMENTS

DE 19951536 C1 * 7/2001 ..... F41C 27/22

* cited by examiner

*Primary Examiner* — Gabriel J. Klein
(74) *Attorney, Agent, or Firm* — Brooks, Cameron, & Huebsch, PLLC

(57) ABSTRACT

In some examples, a guide rod can include: a first shaft that includes a first aperture at a first end, a second shaft positioned within the aperture of the first shaft, a sleeve with a second aperture through an interior portion of the sleeve to receive the first shaft, and a gear mechanism positioned within the first aperture to interact with the second shaft and the sleeve when the sleeve changes position along the first shaft.

15 Claims, 5 Drawing Sheets

GUIDE ROD FOR AUTO RELOADING FIREARM

BACKGROUND

Firearms can be utilized to fire a projectile (e.g., bullet, etc.) through the use of a controlled explosion. In some examples, a firearm, such as an auto-loading pistol, can utilize a guide rod and/or recoil spring to extract a spent casing and load a new cased projectile using the blowback force of the firearm. This blowback force can generate felt recoil to a shooter, which can decrease accuracy of the firearm.

DETAILED DESCRIPTION

An auto-loading firearm, such as an auto-loading pistol, can utilize a guide rod mechanism and/or a spring recoil system to eject a spent casing (e.g., casing that has spent a powdered charge, a casing without a projectile, etc.) and automatically reload a new casing (e.g., casing that includes a powdered charge, a casing that includes a projectile, etc.) utilizing the blowback or slide movement of the auto-loading firearm. The mechanisms of previous types of guide rods is described in U.S. Pat. No. 8,939,059, entitled Progressive Gun Spring Recoil System with High Energy Rebound, filed Oct. 15, 2013, which is incorporated herein by reference.

In some examples, the movement of the slide of a firearm can generate felt recoil for a shooter of the firearm. As used herein, a slide of a firearm can include a moveable portion of a firearm that moves in a first direction to eject a spent casing and moves in a second direction to load a new casing. For example, the slide can include a slide of an auto-loading pistol that moves rearward (e.g., relative to a crown of a barrel, etc.) to eject a spent casing using the force of a controlled explosion of a bullet and moves forward (e.g., relative to the crown of the barrel, etc.) to load a new casing using a spring force of a guide rod and/or spring recoil system. As used herein, a guide rod can include a device to guide the slide along the forward and reward movements and/or a spring mechanism that can be coupled to the device to control the forward and reward movements of the slide.

The present disclosure relates to guide rods that can reduce a felt recoil of a shooter of an auto-loading firearm. In some examples, the guide rods described herein can project a rod in an opposite direction as the movement of the slide in order to reduce the felt recoil of the firearm. For example, when the weight of the slide is moving in a first direction, an interior rod of the guide rod can be projected in a second direction that is opposite of the first direction. In this way, weight from the slide can be moving in the first direction and weight from the interior rod can be moving in the second direction to counteract or partially counteract the force generated by the speed and weight of the slide.

Figure 1:
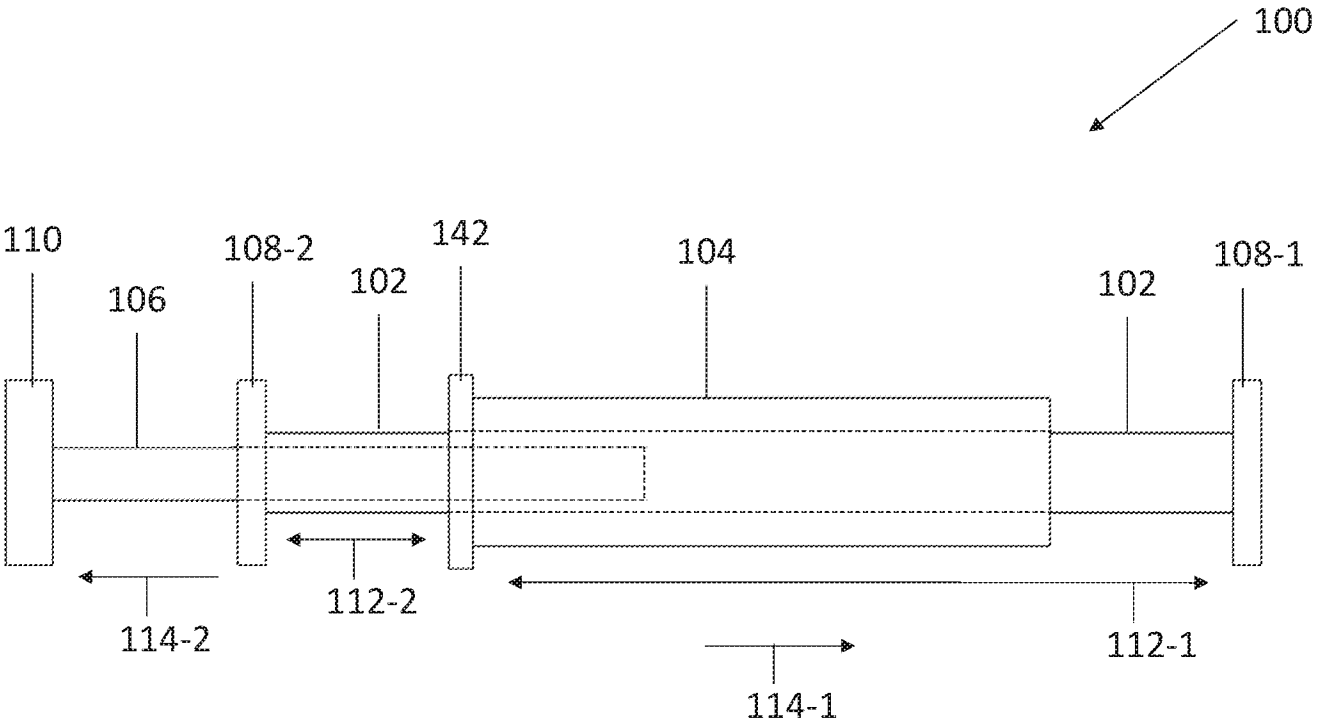
FIG. 1 illustrates an example of a guide rod for a firearm consistent with the disclosure.

FIG. 1 illustrates an example of a guide rod 100 for a firearm consistent with the disclosure. As described herein, the guide rod 100 can include one or more springs that can be utilized to control a quantity of force applied by a slide mechanism of the firearm and/or control a quantity of force provided by the guide rod to move the slide mechanism back to an original position. In some examples, the number of springs can be utilized to move the slide back into battery after the firearm is fired and the movement of the slide ejects a spent casing in a first direction and loads a new casing in a second direction.

In some examples, the guide rod 100 can include a first rod or exterior rod 102 that can include a first end 108-1 and a second end 108-2. In some examples, the exterior rod 102 can be utilized to guide the movement direction of the slide when the slide is moving in a first direction and/or second direction as described herein. In some examples, the exterior rod 102 can be a cylindrical rod (e.g., in the shape of a cylinder, etc.) that includes a first end 108-1 and a second end 108-2. In some examples, the first end 108-1 and the second end 108-2 can be cylindrical shaped ends that are coupled to a corresponding end of the exterior rod 102. In some examples, the guide rod 100 can be positioned within a firearm such that the first end 108-1 can be positioned in contact with a portion of a barrel (e.g., barrel lug, etc.) and the second end 108-2 can be positioned in contact with a portion of the slide (e.g., guide rod aperture, etc.).

In some examples, the guide rod 100 can include a sleeve 104 that can slide along the exterior rod 102 in a first direction and a second direction. For example, the sleeve 104 can include an aperture through the sleeve 104 to allow the sleeve 104 to slide in a direction of arrow 114-1 in response to a casing being fired by a firearm. In some examples, the exterior rod 102 can include a slot or aperture to allow an interaction surface of a gear mechanism positioned within the exterior rod 102 to interact with a corresponding interaction surface on an interior surface of the sleeve 104. For example, the corresponding interaction surface of the interior portion of the sleeve 104 can move the gear mechanism positioned within the exterior rod 102 in a first direction. As described further herein, the movement of the gear mechanism positioned within the exterior rod 102 can initiate movement of an interior rod 106 via the gear mechanism and a corresponding interaction surface on a surface of the interior rod 106. In this way, the movement of the sleeve 104 can be equal and/or opposite to the movement of the interior rod 106. In these examples, the sleeve 104 can be moving in the same or similar direction as a slide of a firearm and thus the interior rod 106 can move in an opposite direction as the slide of the firearm. In some examples, the gear mechanism can be utilized to provide the interior rod 106 to move a greater distance than the distance moved by the slide of the firearm.

In some examples, the exterior rod 102 can include an aperture through the second end 108-2 such that an interior rod 106 can be positioned through a cylindrical portion of the exterior rod 102. As described herein, the interior rod 106 can include an interaction surface that can interact with an interaction surface of a gear mechanism positioned within the exterior rod 102. In this way, the gear mechanism can move the interior rod 106 in the direction of arrow 114-2 as the sleeve 104 moves in the direction of arrow 114-1.

In some examples, the interior rod 106 can include an end 110. In some examples, the end 110 can include a relatively large mass to counteract the mass of the slide moving in the opposite direction. In other examples, the end 110 can include an attachment mechanism to couple a device to the end 110. For example, a number of devices can be coupled to the end 110 in order to increase the mass of the end 110 and/or provide additional functionality. In some examples, the attachment mechanism can be utilized to couple a device, such as a compensator to the end 110. In these examples, the compensator can move in a direction that is opposite a vector or direction of the slide of the firearm, which can further reduce felt recoil from the shooter's perspective.

In other examples, a device, such as a glass breaker, can be coupled to the end 110 through the attachment mechanism. In these examples, a blank round can be utilized by the firearm to project the end 110 toward a glass surface and the glass breaker can break the glass without utilizing a projectile. As used herein, a blank round can include a casing that includes a propellant (e.g., gun powder, etc.) without a projectile. In this way, the firearm can cycle the slide without shooting a projectile through the barrel. When the slide cycles, the end 110 can move in the direction of arrow 114-2 and interact with a surface without a projectile moving through the barrel. Other devices and/or mechanism can be coupled to the end 110 in order to utilize the projection of the interior rod 106 in the direction of arrow 114-2. As used herein, the term cycle can include a routine of an auto-loading pistol being in battery, firing a round, and returning to battery with a new round in the chamber.

In some examples, a number of spring mechanisms can be positioned on or coupled to the guide rod 100. For example, a first spring mechanism can be positioned along arrow 112-1. In this example, the first spring mechanism can include a spring-loaded device that can extend from the first end 108-1 of the exterior rod 102 to a lip 142 of the sleeve 104. As used herein, a lip 142 can included an extended portion of the sleeve 104 to capture the spring mechanism positioned along arrow 112-1. In some examples, the first spring mechanism can be utilized to control the speed of the sleeve 104 when the sleeve is moving in the direction of arrow 114-1 and the first spring mechanism can be utilized to move the sleeve 104 in the direction of arrow 114-2 to return the sleeve 104 to a first position or original position (e.g., position of battery for the slide, etc.). In some examples, the lip 142 can be utilized to apply pressure on the first spring mechanism when the sleeve 104 moves in the direction of arrow 114-1 and/or arrow 114-2.

In some examples, the guide rod 100 can include a second spring mechanism positioned along arrow 112-2. In some examples, the second spring mechanism can extend from the second end 108-2 of the exterior rod 102 to the lip 142 of the sleeve 104. In a similar way as the first spring mechanism, the second spring mechanism can be utilized to control movement of the slide of the firearm during operation. Although a first spring mechanism and a second spring mechanism are described herein, examples of the present disclosure are not so limited. For example, additional or fewer spring mechanisms can be utilized to control the movement of the exterior rod 102, sleeve 104, and/or interior rod 106.

Figure 2:
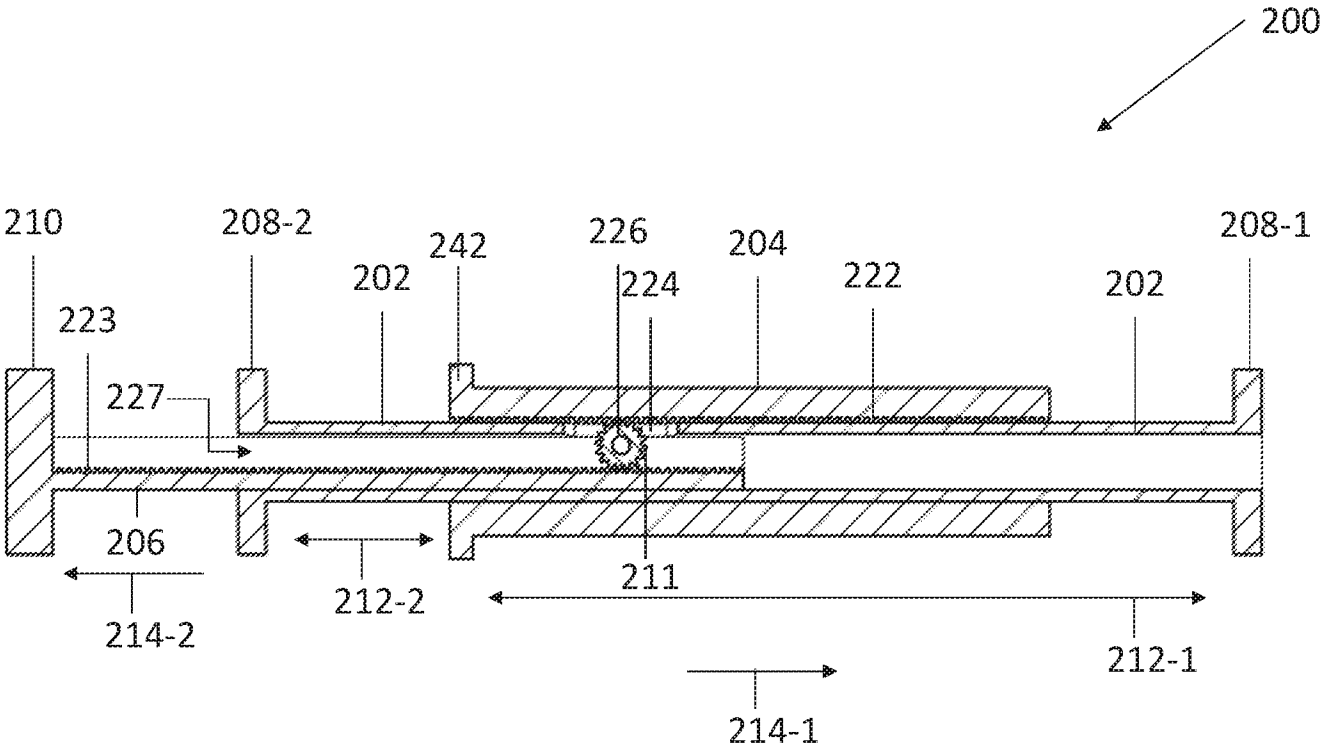
FIG. 2 illustrates an example of a guide rod for a firearm consistent with the disclosure.

FIG. 2 illustrates an example of a guide rod 200 for a firearm consistent with the disclosure. In some examples, the guide rod 200 can be the same or similar device as guide rod 100 as referenced in FIG. 1. In some examples, the guide rod 200 can include a cut away view of the guide rod 100 as referenced in FIG. 1. As described herein, the guide rod 200 can include one or more springs that can be utilized to control a quantity of force applied by a slide mechanism of the firearm and/or control a quantity of force provided by the guide rod to move the slide mechanism back to an original position. In some examples, the number of springs can be utilized to move the slide back into battery after the firearm is fired and the movement of the slide ejects a spent casing in a first direction and loads a new casing in a second direction.

In some examples, the guide rod 200 can include a first rod or exterior rod 202 that can include a first end 208-1 and a second end 208-2. In some examples, the exterior rod 202 can be utilized to guide a direction of the movement of the slide when the slide is moving in a first direction and/or second direction as described herein. In some examples, the exterior rod 202 can be a cylindrical rod (e.g., in the shape of a cylinder, in the shape of an oval, in the shape of an elliptical, etc.) that includes a first end 208-1 and a second end 208-2. In some examples, the first end 208-1 and the second end 208-2 can be cylindrical shaped ends that are coupled to a corresponding end of the cylindrical exterior rod 202. In some examples, the guide rod 200 can be positioned within a firearm such that the first end 208-1 can be positioned in contact with a portion of a barrel and the second end 208-2 can be positioned in contact with a portion of the slide.

In some examples, the guide rod 200 can include a sleeve 204 that can slide along the exterior rod 202 in a first direction and a second direction. For example, the sleeve 204 can include an aperture through the sleeve 204 to allow the sleeve 204 to slide in a direction of arrow 214-1 in response to a casing being fired by a firearm. In some examples, the exterior rod 202 can include a slot or aperture 224 to allow an interaction surface 211 of a gear mechanism 226 positioned within the exterior rod 202 to interact with a corresponding interaction surface 222 on an interior surface of the sleeve 204. For example, the corresponding interaction surface 222 of the interior portion of the sleeve 204 can move the gear mechanism 226 positioned within the exterior rod 202 in a first direction (e.g., clockwise, counterclockwise, etc.). As used herein, a gear mechanism 226 can include a mechanism that can transfer energy from a first surface (e.g., interaction surface 222, etc.) and transfer the energy to a second surface (e.g., interaction surface 223, etc.). As such, the movement of the sleeve 204 is mechanically transferred to the movement of the interior rod 206 through the gear mechanism 226.

As described further herein, the movement of the gear mechanism 226 positioned within the exterior rod 202 can initiate movement of an interior rod 206 via the gear mechanism 226 and a corresponding interaction surface 223 on a surface of the interior rod 206. In this way, the movement of the sleeve 204 can be equal and/or opposite to the movement of the interior rod 206. In these examples, the sleeve 204 can be moving in the same or similar direction as a slide of a firearm and thus the interior rod 206 can move in an opposite direction as the slide of the firearm.

In some examples, the exterior rod 202 can include an aperture 227 through the second end 208-2 such that an interior rod 206 can be positioned through a cylindrical portion of the exterior rod 202. As described herein, the interior rod 206 can include an interaction surface 223 that can interact with an interaction surface 211 of a gear mechanism 226 positioned within the exterior rod 202. In this way, the gear mechanism 226 can move the interior rod 206 in the direction of arrow 214-2 as the sleeve 204 moves in the direction of arrow 214-1.

In some examples, the interior rod 206 can include an end 210. In some examples, the end 210 can include a relatively large mass to counteract the mass of the slide moving in the opposite direction. In other examples, the end 210 can include an attachment mechanism to couple a device to the end 210. For example, a number of devices can be coupled to the end 210 in order to increase the mass of the end 210 and/or provide additional functionality. In some examples, the attachment mechanism can be utilized to couple a device, such as a compensator to the end 210. In these examples, the compensator can move in a direction that is opposite to the direction the slide of the firearm is moving, which can further reduce felt recoil from the shooter's perspective. As used herein, a compensator includes a device (e.g., a muzzle brake, recoil compensator, etc.) connected to, or a feature integral to the construction of, the muzzle or barrel of a firearm or cannon that is intended to redirect a portion of propellant gases to counter recoil and unwanted muzzle rise.

In other examples, a device, such as a glass breaker, can be coupled to the end 210 through the attachment mechanism. In these examples, a blank round can be utilized by the firearm to project the end 210 toward a glass surface and the glass breaker can break the glass without utilizing a projectile. As used herein, a blank round can include a casing that includes a propellant (e.g., gun powder, etc.) without a projectile. In this way, the firearm can cycle the slide without shooting a projectile through the barrel. When the slide cycles, the end 210 can move in the direction of arrow 214-2 and interact with a surface without a projectile moving through the barrel. Other devices and/or mechanism can be coupled to the end 210 in order to utilize the projection of the interior rod 206 in the direction of arrow 214-2.

In some examples, a number of spring mechanisms can be positioned on or coupled to the guide rod 200. For example, a first spring mechanism can be positioned along arrow 212-1. In this example, the first spring mechanism can include a spring-loaded device that can extend from the first end 208-1 of the exterior rod 202 to a lip 242 of the sleeve 204. As used herein, a lip 242 can included an extended portion of the sleeve 204 to capture the spring mechanism positioned along arrow 212-1. In some examples, the first spring mechanism can be utilized to control the speed of the sleeve 204 when the sleeve is moving in the direction of arrow 214-1 and the first spring mechanism can be utilized to move the sleeve 204 in the direction of arrow 214-2 to return the sleeve 204 to a first position or original position (e.g., position of battery for the slide, etc.). In some examples, the lip 242 can be utilized to apply pressure on the first spring mechanism when the sleeve 204 moves in the direction of arrow 214-1 and/or arrow 214-2.

In some examples, the guide rod 200 can include a second spring mechanism positioned along arrow 212-2. In some examples, the second spring mechanism can extend from the second end 208-2 of the exterior rod 202 to the lip 242 of the sleeve 204. In a similar way as the first spring mechanism, the second spring mechanism can be utilized to control movement of the slide of the firearm during operation. Although a first spring mechanism and a second spring mechanism are described herein, examples of the present disclosure are not so limited. For example, additional or fewer spring mechanisms can be utilized to control the movement of the exterior rod 202, sleeve 204, and/or interior rod 206.

As used herein, the interaction surfaces 211, 222, 223 can include a surface that can be utilized to transfer energy. For example, the interaction surfaces 211, 222, 223 can include a plurality of teeth or gear teeth that can interact with corresponding teeth of a different interaction surface. In some examples, the plurality of teeth can be machined such that a first tooth of a first interaction surface can correspond to a groove of a second interaction surface. In other examples, the interaction surfaces 211, 222, 223 can include a plurality of serrations that may not correspond to serrations of other interaction surfaces but utilize friction to move the corresponding device. In other examples, the interaction surfaces 211, 222, 223 can be a relatively rough surface that can create friction between interaction surfaces 211, 222, 223. In some examples, the interaction surfaces 211, 222, 223 can allow for "slippage" between the plurality of teeth. For example, when a threshold force is exceeded, a first tooth on a first interaction surface can slip past a second tooth on a second interaction surface. In this way, the force that exceeds the threshold force may not break teeth of an interaction surface.

In some examples, the gear mechanism 226 can include an interaction surface 211 that can interact with the interaction surface 223 of the interior rod 206 and the interaction surface 222 of the sleeve 204. In some examples, the gear mechanism 226 can be cylindrical in shape. The size of the gear mechanism 226 can be based on a size of a trench of the interior rod 206 such that the gear mechanism 226 can interact with the interaction surface 223 of the interior rod 206 and interact with the interaction surface 222 of the sleeve 204. In some examples, the gear mechanism 226 can be a flexible material that can be pressed between the interaction surface 222 of the sleeve 204 and the interaction surface 223 of the interior rod 206. In some examples, the flexible material can be utilized to create relatively more contact surface between the gear mechanism 226 and the interaction surfaces 222, 223. For example, the gear mechanism 226 can be pressed between the interaction surfaces 222, 223 such that the flexible material applies additional pressure on the interaction surfaces 222, 223 to increase friction between the gear mechanism 226 and the interaction surfaces 222, 223.

Figure 3:
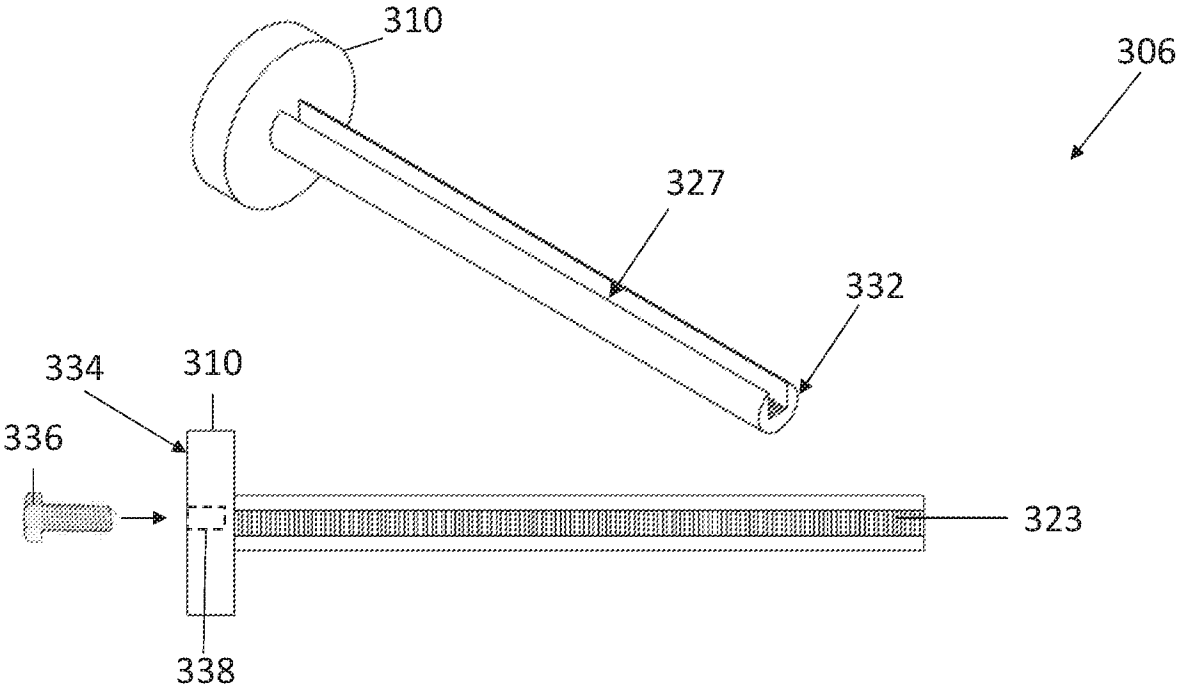
FIG. 3 illustrates an example of an interior rod of a guide rod consistent with the disclosure.

FIG. 3 illustrates an example of an interior rod 306 of a guide rod consistent with the disclosure. As described herein, the interior rod 306 can be positioned within an exterior rod (e.g., exterior rod 102 as referenced in FIG. 1, exterior rod 202 as referenced in FIG. 2, etc.). As described herein, the interior rod 306 can include an end 310. In some examples, the end 310 can include a relatively large mass to counteract the mass of the slide moving in the opposite direction.

In other examples, the end 310 can include an attachment mechanism to couple a device to the end 310. In some examples, the attachment mechanism can include a threaded portion 338 positioned within the end 310 and/or a bolt mechanism 336 that can be threaded into the threaded portion 338. Although a bolt mechanism 336 and threaded portion 338 are described herein, other types of attachment mechanisms can be utilized. For example, other types of attachment mechanisms can be welded or molded into the end 310 without departing from the disclosure.

In some examples, the attachment mechanism can be utilized to attach devices to the end 310. For example, a number of devices can be coupled to the end 310 in order to increase the mass of the end 310 and/or provide additional functionality. In some examples, the attachment mechanism can be utilized to couple a device, such as a compensator to the end 310. In these examples, the compensator can move in a direction that is opposite to the direction of the slide of the firearm, which can further reduce felt recoil from the shooter's perspective. As used herein, a compensator includes a muzzle brake or recoil compensator connected to, or a feature integral to the construction of, the muzzle or barrel of a firearm or cannon that is intended to redirect a portion of propellant gases to counter recoil and unwanted muzzle rise.

In other examples, a device, such as a glass breaker, can be coupled to the end 310 through the attachment mechanism (e.g., device includes an aperture to allow the bolt mechanism 336 to pass through the aperture and couple to the threaded portion 338). In these examples, a blank round can be utilized by the firearm to project the end 310 toward a glass surface and the glass breaker can break the glass without utilizing a projectile. As used herein, a blank round can include a casing that includes a propellant (e.g., gun powder, etc.) without a projectile. In this way, the firearm can cycle the slide without shooting a projectile through the barrel. In some examples, the devices can be coupled to a surface 334 of the end 310.

In some examples, the interior rod 306 can include a trench portion 327. As used herein, a trench portion 327 can include a portion of the cylinder that is removed to generate a trench with at least three sides. For example, the trench portion 327 can include a first side portion, a second side portion, and a bottom portion with an interaction surface 323. In this example, the interaction surface 323 can have the first side portion in direct contact on the first side of the interaction surface 323 and have the second side portion in direct contact on the second side of the interaction surface 323.

In some examples, the trench 327 can extend from the first end 310 to a second end 332. In some examples, the trench can be a particular depth. For example, the depth of the trench can be based on a size of a gear mechanism (e.g., gear mechanism 226 as illustrated in FIG. 2, etc.). For example, the depth of the trench 327 can allow the gear mechanism to be positioned within the trench 327 to interact with the interaction surface 323 of the interior rod 306 and an interaction surface positioned on an interior surface of a sleeve (e.g., sleeve 104 as referenced in FIG. 1, sleeve 204 as referenced in FIG. 2, etc.). In this way, a movement of the sleeve can result in a movement of the interior rod 306.

In some examples, the second end 332 may not include a cap or cylindrical end as illustrated at the first end 310. For example, the second end 332 can be inserted into an aperture of an exterior rod (e.g., exterior rod 102 as illustrated in FIG. 1, exterior rod 202 as illustrated in FIG. 2, etc.). In some examples, the second end 332 can include a stopping mechanism to prevent the interior rod 306 from being removed from the exterior rod. In some examples, the second end 332 can be coupled to a spring mechanism to apply a force on the interior rod 306. For example, a spring mechanism can be coupled to the second end 332 to ensure that the interior rod 306 returns to a starting position after being moved by a gear mechanism. In this way, the interior rod 306 can be returned to a starting point even if the gear mechanism does not completely return the interior rod 306 to a starting position. In some examples, the starting position can include a position where the end 310 is in contact with an end of the exterior rod.

Figure 4:
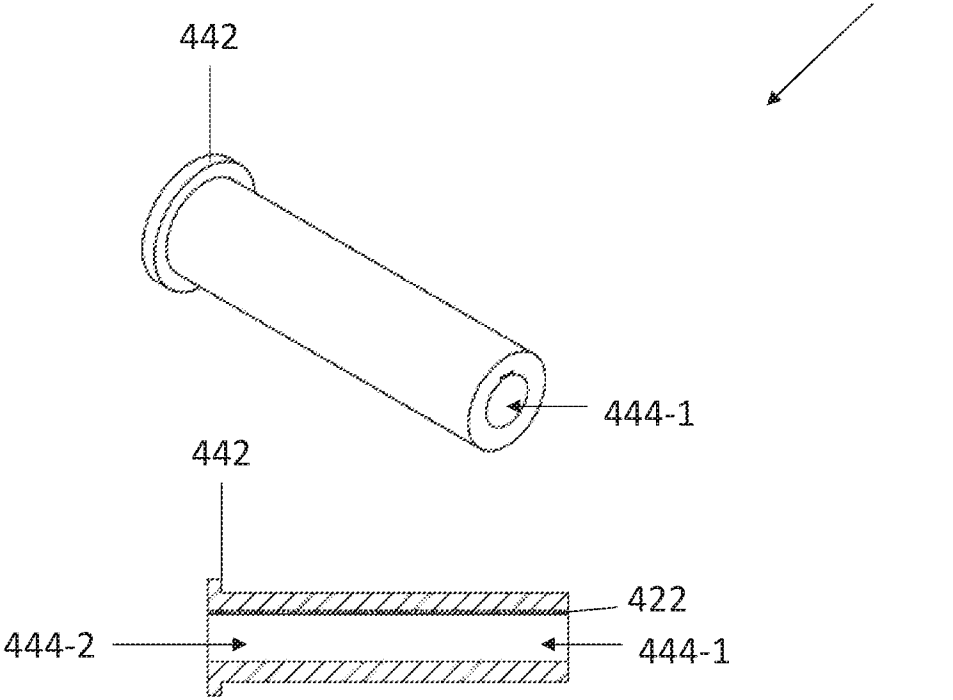
FIG. 4 illustrates an example of a sleeve of a guide rod consistent with the disclosure.

FIG. 4 illustrates an example of a sleeve 404 of a guide rod consistent with the disclosure. In some examples, the sleeve 404 can be the same or similar device as sleeve 104 as illustrated in FIG. 1, and/or sleeve 204 as illustrated in FIG. 2. In some examples, the sleeve 404 can be utilized to capture a spring mechanism utilizing a lip 442. For example, a spring mechanism can be positioned along an exterior portion of the sleeve 404 and the lip 442 can be utilized to apply pressure on the spring mechanism or receive pressure from the spring mechanism when the sleeve 404 moves.

In some examples, the sleeve 404 can include an aperture 444-1, 444-2 through the sleeve 404 to allow the sleeve 404 to slide in a first direction in response to a casing being fired by a firearm. In some examples, the sleeve 404 can include an interaction surface 422 along the interior of the aperture 444-1, 444-2. In some examples, the interaction surface 422 of the interior portion of the sleeve 404 can move a gear mechanism (e.g., rotate a gear mechanism, etc.) positioned within the exterior rod in a first direction (e.g., clockwise, counterclockwise, etc.) when the sleeve 404 is moving in a first direction and move the gear mechanism in a second direction when the sleeve 404 is moving in a second direction.

Figure 5:
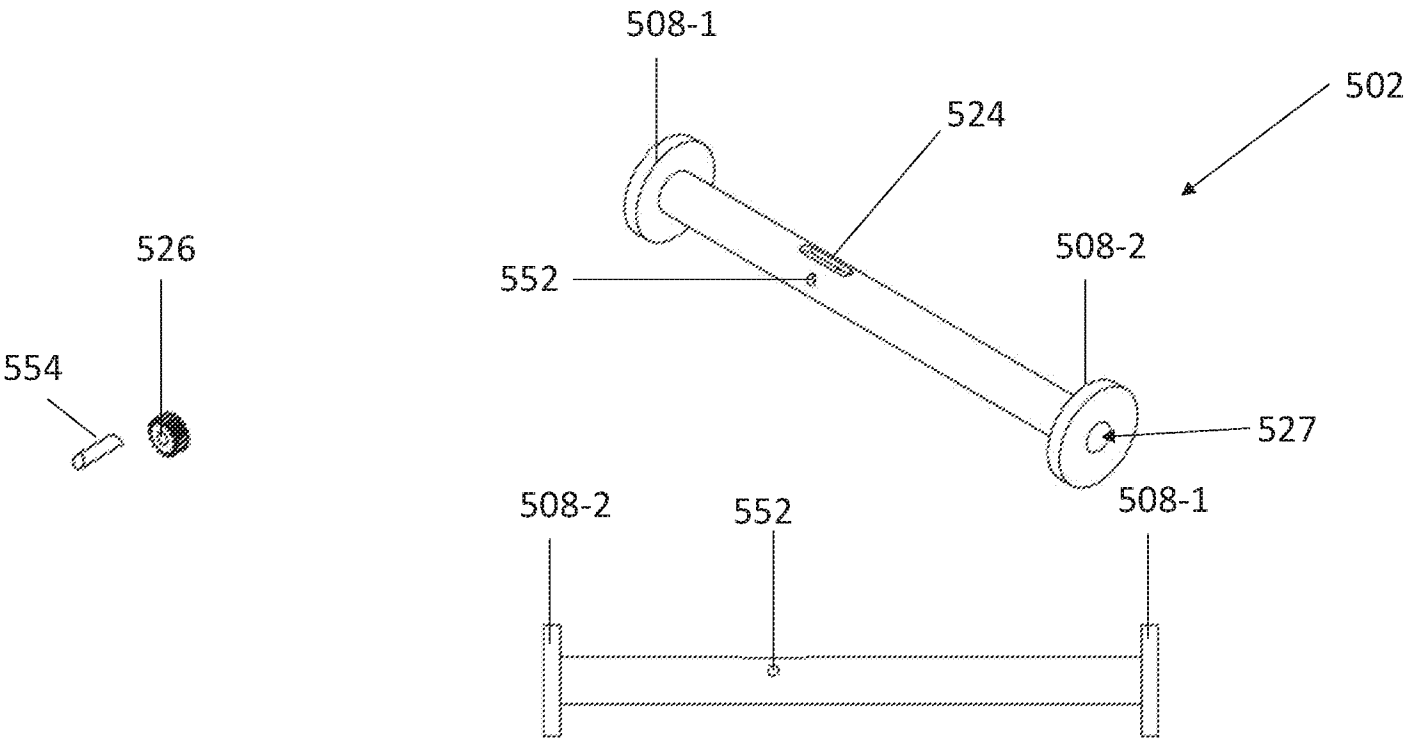
FIG. 5 illustrates an example of an exterior rod of a guide rod consistent with the disclosure.

FIG. 5 illustrates an example of an exterior rod 502 of a guide rod consistent with the disclosure. In some examples, the exterior rod 502 can be the same or similar device as exterior rod 102 as illustrated in FIG. 1, and/or exterior rod 202 as illustrated in FIG. 2. In some examples, the exterior rod 502 can be utilized to guide movement of a slide of a firearm as described herein.

In some examples, the exterior rod 502 can include a first end 508-1 and a second end 508-2. In some examples, the exterior rod 502 can be a cylindrical rod (e.g., in the shape of a cylinder, etc.) that includes a first end 508-1 and a second end 508-2. In some examples, the first end 508-1 and the second end 508-2 can be cylindrical shaped ends that are coupled to a corresponding end of the cylindrical exterior rod 502. In some examples, the first end 508-1 can be positioned in contact with a portion of a barrel and the second end 508-2 can be positioned in contact with a portion of the slide.

In some examples, the exterior rod 502 can include an aperture 527 through the second end 508-2 such that an interior rod can be positioned through a cylindrical portion of the exterior rod 502. As described herein, the interior rod can include an interaction surface that can interact with an interaction surface of a gear mechanism 526 positioned within the exterior rod 502. In this way, the gear mechanism 526 can move the interior rod in the opposite direction of the sleeve as it moves (e.g., rotates about a pin 554, etc.). In some examples, the exterior rod 502 can include a slot or aperture 524 to allow an interaction surface of a gear mechanism 526 positioned within the exterior rod 502 to interact with a corresponding interaction surface on an interior surface of a sleeve. For example, the corresponding interaction surface of the interior portion of the sleeve can move the gear mechanism 526 (e.g., rotate about a pin 554 at a center, etc.) positioned within the exterior rod 502 in a first direction (e.g., clockwise, counterclockwise, etc.). That is, the gear mechanism within the exterior rod 502 can protrude through the aperture 524 to interact with a sleeve positioned over the exterior rod 502.

In some examples, the exterior rod 502 can include a pin aperture 552 to allow a pin 554 to pass through a gear mechanism 526 to be coupled within the exterior rod 502 while allowing the gear mechanism 526 to rotate (e.g., in a clockwise or counterclockwise direction, etc.). In some examples, the pin aperture 552 can protrude through the cylindrical shaft of the exterior rod 502. In this way, the gear mechanism 526 can be coupled to a first interior edge and a second interior edge of the exterior rod 502 when the pin 554 passes through pin aperture 552. Although a pin 554 and pin aperture 552 are illustrated, other mechanisms can be utilized to couple the gear mechanism 526 within the exterior rod 502.

In the foregoing detailed description of the disclosure, reference is made to the accompanying drawings that form a part hereof, and in which is shown by way of illustration how examples of the disclosure can be practiced. These examples are described in sufficient detail to enable those of ordinary skill in the art to practice the examples of this disclosure, and it is to be understood that other examples can be utilized and that process, electrical, and/or structural changes can be made without departing from the scope of the disclosure.

The figures herein follow a numbering convention in which the first digit corresponds to the drawing figure number and the remaining digits identify an element or component in the drawing. Similar elements or components between different figures can be identified by the use of similar digits. For example, 102 can reference element "02" in FIG. 1, and a similar element can be referenced as 202 in FIG. 2. Elements shown in the various figures herein can be added, exchanged, and/or eliminated so as to provide a plurality of additional examples of the disclosure. In addition, the proportion and the relative scale of the elements provided in the figures are intended to illustrate the examples of the disclosure and should not be taken in a limiting sense. As used herein, the designator "N", particularly with respect to reference numerals in the drawings, indicates that a plurality of the particular feature so designated can be included with examples of the disclosure. The designators can represent the same or different numbers of the particular features. Further, as used herein, "a plurality of" an element and/or feature can refer to more than one of such elements and/or features.

What is claimed:

1. An apparatus for an auto-loading pistol, comprising:

a guide rod, having:

a first shaft that includes a first aperture at a first end;

a second shaft positioned within the aperture of the first shaft;

a sleeve with a second aperture through an interior portion of the sleeve to receive the first shaft; and a gear mechanism positioned within the first aperture to interact with the second shaft and the sleeve when the sleeve changes position along the first shaft.

2. The apparatus of claim 1, wherein the first aperture extends through a portion of the interior of the first shaft.

3. The apparatus of claim 1, wherein the gear mechanism includes a first plurality of teeth that surround the gear mechanism.

4. The apparatus of claim 3, wherein the sleeve includes a second plurality of teeth that interact with the first plurality of teeth and wherein the second shaft includes a third plurality of teeth that interact with the first plurality of teeth.

5. The apparatus of claim 4, wherein the second plurality of teeth interact with the first plurality of teeth when the sleeve is moved in a first direction and the third plurality of teeth interact with the first plurality of teeth when the second shaft is moved in a second direction.

6. The apparatus of claim 4, wherein the sleeve is moved in a first direction in response to a firing of an auto-loading pistol and the second shaft is moved in a second direction that is opposite the first direction when the second plurality of teeth interact with the first plurality of teeth.

7. A guide rod, comprising:

a first shaft comprising a first end to be positioned in contact with a barrel of an auto-loading pistol and a second end to be positioned in contact with a slide of an auto-loading pistol, wherein the first shaft includes a first aperture through the second end and a second aperture positioned between the first end and the second end;

a second shaft comprising a first interaction surface, wherein the second shaft is moveable within the first aperture of the first shaft;

a sleeve comprising a third aperture through a first end and a second end of the sleeve to allow the first shaft to be moveable within the third aperture, wherein the sleeve includes a second interaction surface within the third aperture; and a gear mechanism comprising a third interaction surface that corresponds to the first interaction surface and second interaction surface, wherein the gear mechanism interacts with the second interaction surface through the second aperture.

8. The guide rod of claim 7, wherein a mechanism of the auto-loading pistol moves the sleeve in a first direction that forces an interaction between the second interaction surface and the third interaction surface and moves the second shaft in a second direction through an interaction between the first interaction surface of the second shaft and the third interaction surface of the gear mechanism.

9. The guide rod of claim 7, comprising a first spring mechanism positioned between the sleeve and the first end of the first shaft and a second spring mechanism positioned between the sleeve and the second end of the first shaft.

10. A system comprising:

an auto-loading pistol that utilizes a force from an explosion to move a slide in a first direction to extract an empty casing and utilizes a spring force from a guide rod to move the slide in a second direction to load a new casing from a magazine;

the guide rod comprising:

a first shaft comprising a first end to be positioned in contact with a barrel of the auto-loading pistol and a second end to be positioned in contact with the slide of an auto-loading pistol, wherein the first shaft includes a first aperture through the second end and a second aperture positioned between the first end and the second end;

a second shaft comprising a first interaction surface, wherein the second shaft is moveable within the first aperture of the first shaft;

a sleeve comprising a third aperture through a first end and a second end of the sleeve to allow the first shaft to be moveable within the third aperture, wherein the sleeve includes a second interaction surface within the third aperture; and a gear mechanism comprising a third interaction surface that corresponds to the first interaction surface and second interaction surface, wherein the gear mechanism interacts with the second interaction surface through the second aperture.

11. The system of claim 10, wherein the second shaft includes a third end that moves in the second direction when the explosion moves the slide in the first direction.

12. The system of claim 11, comprising a compensator device coupled to the third end.

13. The system of claim 11, comprising a glass breaker device coupled to the third end.

14. The system of claim 10, wherein the gear mechanism is pinned through the first shaft, wherein the pinned gear mechanism is able to rotate within the first shaft.

15. The system of claim 10, wherein the third interaction surface includes a plurality of grooves to catch and interact with the first interaction surface and second interaction surface.

* * * * *